United States Patent [19]

Jones

[11] Patent Number: 4,500,089

[45] Date of Patent: Feb. 19, 1985

[54] WEIGHT LIFTING LOWER BACK EXERCISING MACHINE

[75] Inventor: Arthur A. Jones, Lake Helen, Fla.

[73] Assignee: Nautilus Sports/Medical Industries, Inc., Lake Helen, Fla.

[21] Appl. No.: 459,508

[22] Filed: Jan. 20, 1983

[51] Int. Cl.[3] ..... A63B 21/06

[52] U.S. Cl. ..... 272/117; 272/118

[58] Field of Search ..... 272/118, 117, 134, 136, 272/142, 93; 128/25 R

[56] References Cited

U.S. PATENT DOCUMENTS

| | | | |
|---|---|---|---|
| 2,223,309 | 11/1940 | Swanson | 272/142 X |
| 3,465,750 | 9/1969 | Schawalder | 272/142 X |
| 3,856,297 | 12/1974 | Schnell | 272/117 X |
| 4,240,626 | 12/1980 | Lambert | 272/134 X |

*Primary Examiner*—Richard J. Apley
*Assistant Examiner*—William R. Browne
*Attorney, Agent, or Firm*—Bell, Seltzer, Park & Gibson

[57] ABSTRACT

This machine includes a saddle-type seat for supporting the user in substantially an upright position with the legs being maintained in position during use of the machine. A user-actuated lever is provided with a padded roller on one end thereof. The padded roller is adapted to engage the back of the user at a position substantially in alignment with the shoulder blades and the other end of the lever is pivotally supported at a position in substantial alignment with the waist of the user. The other end of the user-actuated lever is operatively connected to weights. The connection between the user-actuated lever and the weights includes a variable radius cam for providing a variable resistance force to lifting and lowering the weights with corresponding movement of the user between a first position with the spine in a forwardly bent position and a second position with the spine in a substantially straight position to provide a full range exercising of the muscles associated with the lower back of the user.

13 Claims, 7 Drawing Figures

WEIGHT LIFTING LOWER BACK EXERCISING MACHINE

FIELD OF THE INVENTION

This invention relates generally to a lower back exercising machine and more particularly to such a machine which provides a varying amount of resistance force to the user in various positions of movement when exercising the muscles in the lower back.

BACKGROUND OF THE INVENTION

During recent years, a variety of different types of exercising machines have been developed for exercising and strengthening certain groups of muscles in the body. However, no real effort has been made to develop a machine which is particularly adapted for exercising the muscles in the lower back, and particularly no such machine has been developed which varies the resisting force against the muscles when the back is moved back and forth between a forwardly bent position and a position with the spine in a substantially straight position.

It has been proposed that the muscles in the lower back may be exercised by repeatedly performing a so-called "dead lift" of a barbell weight in which a person maintains the legs stiff and bends the back forwardly and lifts the weight from the floor while straightening the back and then again bends the back forwardly while lowering the barbell weight to the floor. In this type of exercise, the resistance to the lifting force is very high when the spine is bent forwardly and the resistance force is reduced to near zero when the spine is in the straight or upright position. In this upright position, the only force being applied is a compression force on the spine and no resistance force is being applied to the muscles of the lower back. Therefore, the resistance force applied to the muscles in the lower back is not properly varied throughout all positions of the exercising movement.

It has also been proposed that the lower back muscles be exercised by a "hyper-extension" type of exercise in which the person lays face down on an elevated bench or platform with the feet restrained and with the upper portion of the body extending outwardly beyond one end of the bench. This exercise begins with the upper portion of the body hanging downwardly from the bench or platform with the spine in a forwardly bent position and then the upper portion of the body is raised and moved upwardly to substantially a horizontal position so that the spine is substantially straight. The upper portion of the body is then lowered and moved back to the forwardly bent position. In this exercise, the resistance to movement of the muscles in the lower back is very low and practically no resistance force is provided when the back is in the forwardly bent position while maximum resistance force is provided at the end of the upward movement. Thus, this exercise does not provide the proper amount of variable resistance throughout the entire movement of the upper body. Also, a pulling or extension force is applied to the spine when the upper portion of the body is in a vertical downwardly extending position.

SUMMARY OF THE INVENTION

With the foregoing in mind, it is an object of the present invention to provide a lower back exercising machine which provides the proper amount of varied resistance force to the muscles throughout the entire exercising movement and without imposing compressive or extension forces on the spine of the user.

The lower back exercising machine of the present invention includes a user-actuated lever which is pivotally supported at one end and at substantially the level of the waist of the user. The other end of the user-actuated level is positioned for engagement with the back of the user and in substantial alignment with the shoulder blades. The pivoted end of the user-actuated lever is provided with a variable radius cam with flexible connector means being connected at one end to the variable radius cam and at its other end to weights. As the user successively moves the upper portion of the body back and forth between a position with the spine in a forwardly bent position and a position with the spine in substantially straight position, the user-actuated lever is moved in a limited arcuate path of movement to successively lift and lower the weight and the variable radius cam provides the proper amount of resistance force throughout the entire movement of the back of the user.

The present lower back exercising machine is provided with a saddle-type seat for supporting the user with the legs extending outwardly and downwardly on opposite sides of the seat. A pair of eccentrically supported padded rollers is supported for rotation forwardly of and on opposite sides of the saddle-type seat and are rotatable into clamping engagement with the upper portions of the legs of the user for restraining the legs during exercising on the machine. The padded rollers are rotatable out of engagement with the legs for ease of entry and exit of the user to the machine.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 3:
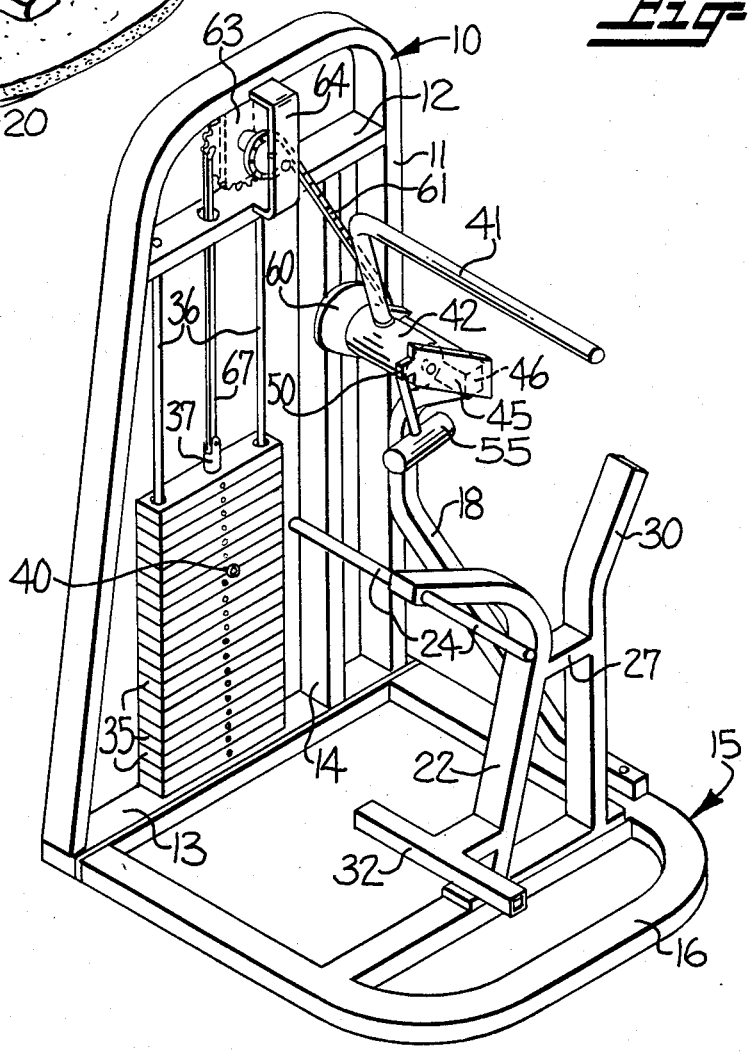
FIG. 3 is a view similar to FIG. 1 but with the frame covers, seat and padded rollers removed to illustrate the construction of the supporting frame.

As best shown in FIG. 3, the lower back exercising machine of the present invention includes an upright frame, broadly indicated at 10. The upright frame 10 inclues a continuous outer frame member 11 having a vertical rear leg, a horizontal upper part, and an inclined front leg. A cross-frame member 12 extends between the front and rear legs of the outer frame 11 and is fixed at opposite ends thereto. A lower horizontal frame member 13 is connected at opposite ends to the lower ends of the front and rear legs of the outer frame 11, and a vertical frame member 14 is fixed at its lower end to the lower frame member 13 and at its upper end to the cross-frame member 12.

A horizontal frame broadly indicated at 15, is connected at one side to the lower frame member 13 of the upright frame 10 and extends outwardly therefrom and includes an outer frame member 16. A cross-frame member 17 is fixed at opposite ends to the front and rear legs of the outer frame member 16. A diagonal brace member 18 is fixed at its lower end on the rear leg of the outer frame member 16 and is fixed adjacent its upper end on the rear leg of the outer frame member 11. The upper end of the brace member 18 extends outwardly and upwardly from the rear leg of the outer frame member 11, for purposes to be presently described. A carpeted platform 20 covers and is positioned on the upper portion of the horizontal frame member 15.

Figure 5:
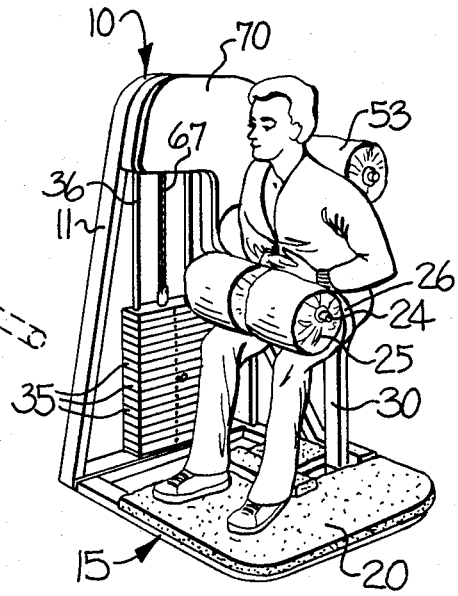
FIGS. 5, 6, and 7 are front perspective views of the lower back exercising machine and illustrating the successive movement of the user between a position with the spine in a forwardly bent position and a position with the spine in a substantially straight position.
Figure 6:
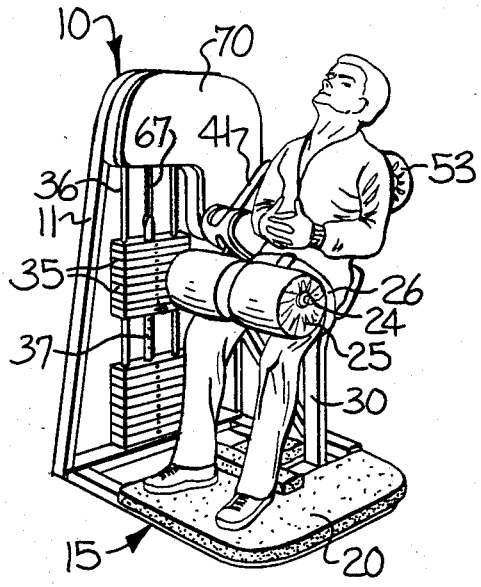
Figure 7:
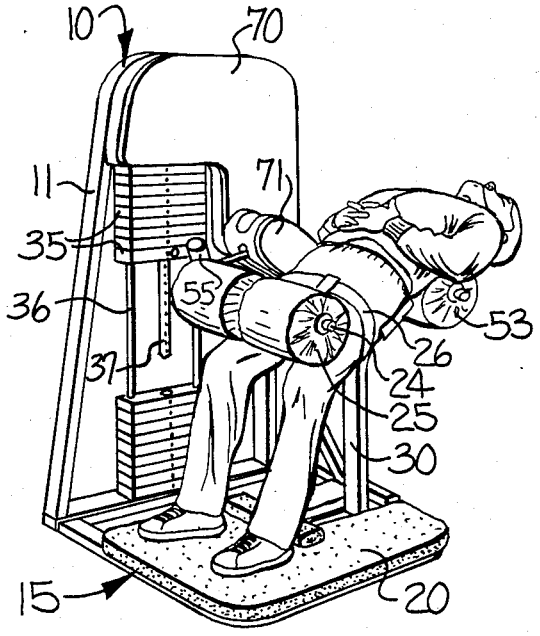

A saddle-type seat 21 is supported on the forwardly curved upper portion of a support member 22, the lower end of which is fixed on the cross-frame 17. The seat 21 is positioned for supporting the user with the legs extending outwardly and downwardly from opposite sides of the seat 21, as illustrated in FIGS. 5–7. The forward end of the seat support member 22 is provided with a transversely extending pivot shaft or rod 24 on which a pair of padded rollers 25 is supported for rotational movement. The padded rollers 25 are supported for eccentric rotation about the shaft 24 and are rotatable into clamping engagement with the upper portions of the legs of the user, as illustrated in FIGS. 5–7, and are rotatable out of engagement with the legs so that the user can easily get into and out of the machine. The padded rollers 25 form a part of the restraining means engageable with the legs of the user to retain the lower body and legs in position during use of the machine.

The restraining means also includes a seat belt 26 which is attached to a cross brace 27. One end of the cross brace 27 is fixed on the suppport member 22 and the other end is fixed on a vertical support member 30. A backrest 31 is fixed on the upper end of the support 30 and is inclined rearwardly and extends at substantially a right angle to the saddle-type seat 21. The backrest 31 extends upwardly substantially to the waist of the user for supporting the lower back of the user during use of the exercising machine.

A footrest support frame 32 (FIG. 3) is attached to the support 22 and extends outwardly therefrom. A carpeted footrest 33 is supported on the frame 32. The footrest 33 is provided for use by people with short legs so that they can position their feet on the footrest 33 when using the exercising machine. A normal size adult will use the machine with the feet positioned on the platform 20, as illustrated in FIGS. 5–7.

Figure 4:
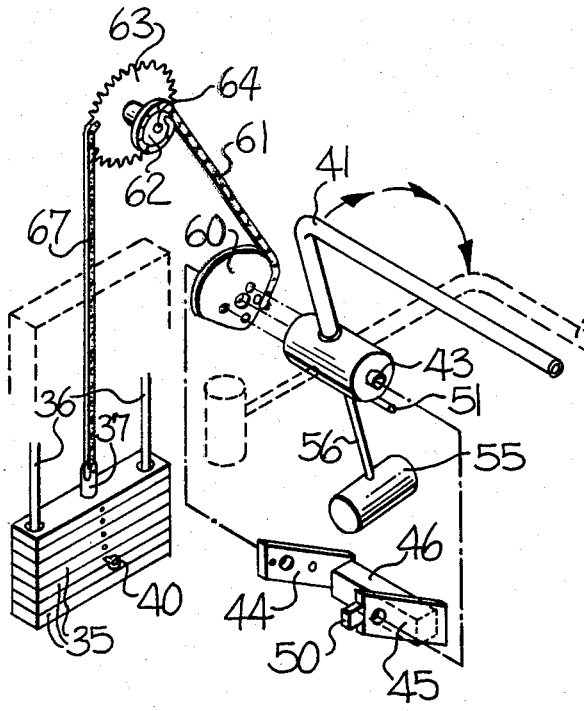
FIG. 4 is a somewhat schematic isometric view illustrating the manner in which the user-actuated lever is operatively connected to the variable radius cam and to the weights.

Weight means is supported for vertical movement by the upright frame 10 and includes a plurality of weight plates 35 which are supported for sliding movement adjacent opposite ends on guide rods 36. The upper ends of the guide rods 36 are fixed on the cross frame 12 and at their lower ends on the frame member 13. A vertical selector guide and weight lifting rod 37 extends through the central portions of the weight plates 35 and is provided with spaced-apart openings for reception of a selector pin 40 so that varing amounts of weight can be selected by the user to be lifted and lowered when exercising with the machine. User-actuated lever means is provided and includes a lever 41 having vertical and horizontal legs and the vertical leg is fixed at its lower end to a pivot hub 42. The pivot hub 42 is supported on a shaft 43 which is supported at opposite ends in respective support bars 44, 45 (FIG. 4). The support bar 44 is fixed to the vertical frame member 14 and to the rear leg of the outer frame 11. A connector bar 46 is fixed at opposite ends to the support bars 44, 45 and is fixed to the outwardly and upwardly curved upper end of the diagonal support member 18. The support bar 45 is provided with a forwardly extending stop member 50 and the pivotal hub 42 is provided with an outwardly extending stop pin 51 (FIG. 4) for purposes to be presently described.

The horizontal leg of the lever 41 is provided with a rotatable padded roller 53 which is positioned for engagement with the back of the user and at a position in substantial alignment with the shoulder blades thereof. A counterweight 55 is supported on the lower end of a support rod 56, the upper end of which is fixed in the pivot hub 42. When the lever 41 is in the forward position, as shown in solid lines in FIG. 4, the stop pin 51 engages the lower surface of the support bar 45 to limit forward movement of the lever 41. When the lever 41 is moved rearwardly, as shown in dotted lines in FIG. 4, the stop pin 51 engages the stop member 50 to limit rearward arcuate movement of the lever 41.

Means is provided for operatively connecting one end of the user-actuated lever means with the weight means to provide the proper variable resistance for lifting and lowering the weight means with corresponding movement of the user-actuated lever in a limited arcuate path of back-and-forth movement between a first position with the spine of a user in a forwardly bent position and a second position with the spine in a substantially straight position. This operative connecting means includes a variable radius cam 60 which is fixed on one end of the pivot hub 42 (FIG. 5).

Flexible connector means is provided between the variable radius cam 60 and the weight plates 35 and includes a sprocket chain 61, connected at one end to the variable radius cam 60 and at its other end to a relatively small sprocket 62. The sprocket 62 is fixed on a hub which is connected to a larger sprocket 63. The sprockets 62, 63 and connecting hub are supported on a pivot shaft 64, one end of which is fixed in a bracket 64 and the other end of which is fixed in a vertical brace member 65 (FIG. 3). A sprocket chain 67 is connected at one end to the large sprocket 63 and its other end is connected to the upper end of the weight supporting guide rod 37.

The variable radius cam 60 provides a different length of lever or moment arm at different rotational positions so as to vary the amount of force required to be exerted by the back of the user in different positions of movement. Thus, the resistance force on the user-actuated lever 41 and padded roller 53 is varied when lifting and lowering the weight plates 35, in accordance with the angular position of the user-actuated lever 41 as the user moves back and forth between the forwardly bent and the straight positions, as shown in FIGS. 5–7.

In order to protect the user from engagement with the sprockets 62, 63, an inside cover plate 70 is fixed to the upper inside portion of the upright frame 10. A protective cover housing 71 is also provided to cover the pivot hub 42 of the user-actuated lever 41. The cover housing 71 is fixed to the upright frame 10 and at the lower rear end of the inside cover plate 70.

Figure 1:
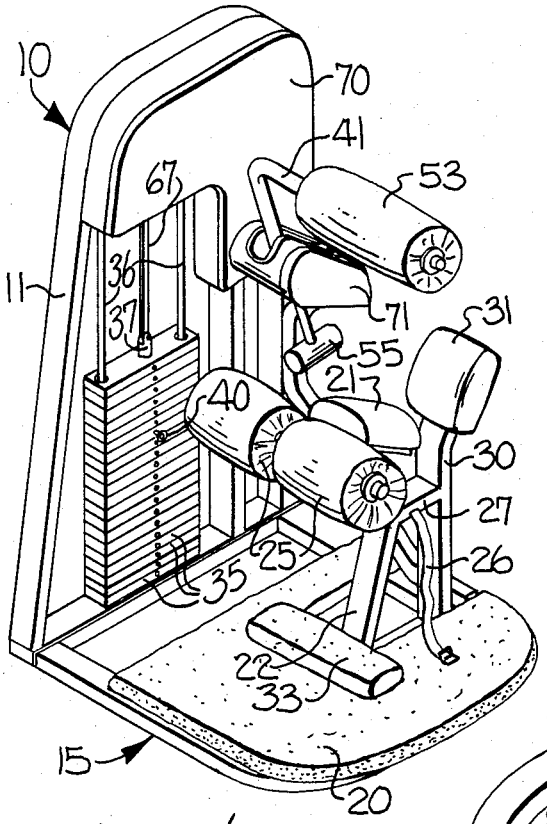
FIG. 1 is an isometric frontal view of the present lower back exercising machine.
Figure 2:
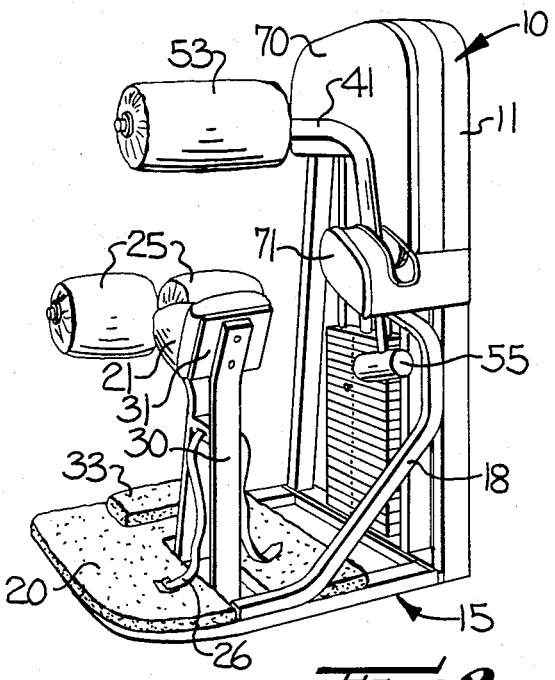
FIG. 2 is a rear perspective view of the lower back exercising machine.

When the machine is not in use, as illustrated in FIGS. 1 and 2, the lever 41 and the padded roller 53 are in the forward position and are maintained in this position by the weight plates 35 and the forward movement is limited by the stop pin 51 engaging the lower surface of the brace member or support bar 45. The user enters the machine by first rotating the padded rollers 25 in a counterclockwise direction and then straddles the saddle-type seat 21 with the back bent forwardly. The rollers 25 are then rotated in a clockwise direction to clampingly engage the upper portions of the legs and the seat belt 26 is buckled into position across the lap of the user, as illustrated in FIG. 5.

The lower back exercise begins with the spine bent forwardly and the padded roller 53 engaging the back at a position substantially in alignment with the shoulder blades. The user then moves the upper portion of the body rearwardly exerting pressure against the back and applying force against the roller 53. The lever 41 is moved in an arcuate path until the spine is in a substantially straight position, as shown in FIG. 7. At this position, the stop pin 51 will engage the stop 50 on the support bar 45 (FIG. 4) to limit the rearward movement of the lever 41. The user will then move the upper portion of the body forwardly from the position shown in FIG. 7 to the position shown in FIG. 5. This back-and-forth movement is continued until the proper number of exercise movements have been accomplished.

The user can utilize as many of the weight plates 35 as desired by positioning the selector pin 40 in the proper weight plate to lift the weights above the position of the selector pin 40. With each back-and-forth movement of the lever 41, the variable radius cam 60 provides the proper type of varying resistance force required to be exerted by the user for the proper exercise of the muscles in the lower back, the variable amount of resistance force being applied, in accordance with the angular position of the lever 41 at any given position in the exercising movement. Upon completion of the exercising session, the user will simply unbuckle the seat belt 26, rotate the padded rollers 25 in a counterclockwise direction and step out of the saddle-type seat 21.

It will be noted that the pivotal axis of the lever 41 is substantially in alignment with the waist of the user during the exercising movement and the backrest 31 supports the lower back of the user so that the bending motion of the user takes place primarily at the level of the waist. This movement of the spine back and forth at the level of the waist provides a full range of exercise of the muscles associated with the lower back of the user.

The lower back exercising machine of the present invention is simple to operate, provides full range exercising of the muscles associated with the lower back of the user and does not apply any appreciable amount of compressive or extension forces to the spine of the user. The variable radius cam provides a variable resistance force to the lifting and lowering of the weights with corresponding movement of the user-actuated lever so that the amount of force required to be exerted by the back of the user is proper in all angular positions of the user-actuated lever.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A machine for exercising the muscles associated with the lower back of the user and comprising (a) a frame, (b) a seat connected to said frame for supporting the user, (c) resistance means for opposing movement of a user while the latter is positioned on said seat, said resistance means being connected to said frame, (d) user-actuated lever means for engaging the back of a user while a user is positioned on said seat, said lever means having one end pivotally connected to said frame, the other end of said lever means continuously engaging the back of the user at a position spaced above the waist of the user, said lever means being movable in an arcuate path of movement between a first position with the spine of the user in a forwardly bent position, and a second position with the spine in a substantially straight position, and (e) means operatively connecting said lever means with said resistance means for transmitting movement of said user-actuated lever means between said first and second positions for exercising the muscles associated with the lower back of the user.

2. An exercising machine according to claim 1 wherein said means operatively connecting said lever means with said resistance means includes a variable radius cam rotatable with said user-actuated lever means, and wherein said variable radius cam is operatively connected to said resistance means to vary the amount of force required to be exerted by the back of the user on said user-actuated lever means in accordance with the angular position of said user-actuated lever means.

3. The exercising machine of claim 1 wherein said resistance means comprises weight means supported for vertical movement to provide resistance through lifting and lowering.

4. The exercising machine of claim 1 wherein said one end of said user actuated lever means is connected to said frame at a position above the level of said seat and at substantially the level of the waist of the user.

5. The exercising machine of claim 1 further comprising restraining means engageable with the user for retaining the lower body and legs of the user in position during use of the machine.

6. A machine for exercising the muscles associated with the lower back of the user and comprising (a) a frame, (b) a seat connected to said frame, (c) restraining means engageable with the user for retaining the lower body and legs of the user in position during use of the machine, (d) resistance means for opposing movement of a user while the latter is positioned on said seat, said resistance means being connected to said frame, (e) user-actuated lever means for engaging the back of a user while a user is positioned on said seat, lever means having one end pivotally connected to said frame at a position above the level of said seat and at substantially the level of the waist of the user, the other end of said lever means continuously engaging the back of the user at a position spaced above the waist of the user, said lever means being movable in an arcuate path of movement between a first position with the spine of the user in a forwardly bent position, and a second position with the spine in a substantially straight position, and (f) means operatively connecting said lever means with said resistance means for transmitting movement of said user-actuated lever means between said first and second positions for exercising the muscles associated with the lower back of the user.

7. The exercising machine of claim 6 wherein said resistance means comprises weight means supported for vertical movement to provide resistance through lifting and lowering.

8. An exercising machine according to claim 6 including a backrest supported rearwardly of and extending at substantially right angles to said seat, said backrest extending upwardly substantially to the waist of user for supporting the lower back of user.

9. An exercising machine according to claim 6 wherein said restraining means includes a pair of padded rollers, means supporting said padded rollers for rotation forwardly of and on opposite sides of said seat, said padded rollers for eccentric rotation and being movable into clamping engagement with the upper portions of the legs of the user and being rotatable out of engagement with the legs for entry and exit of the user to the machine.

10. An exercising machine according to claim 1 wherein said restraining means comprises a flexible belt adapted to be connected around and across the lap of the user to aid in retaining the user in position on said seat and with the lower portion of the back in engagement with said backrest.

11. An exercising machine according to claim 1 wherein said weight means comprises a plurality of vertically stacked weight plates, and means for selectively attaching various numbers of said weight plates to be lifted and lowered.

12. An exercising machine according to claim 1 including a padded roller rotatably supported on said other end of said user-actuated lever means and being positioned to be engaged by the back of the user at a position substantially in alignment with the shoulder blades thereof.

13. An exercising machine according to claim 1 wherein said means operatively connecting said lever means with said resistance means includes flexible connector means, and a variable radius cam rotatable with said user-actuated lever means, said flexible connector means being connected at one end to said weight means and at the other end to said variable radius cam, said variable radius cam being operable to vary the amount of force required to be exerted by the back of the user on said user-actuated lever means in lifting and lowering said weight means in accordance with the angular position of said user-actuated lever means.

* * * * *

UNITED STATES PATENT AND TRADEMARK OFFICE

CERTIFICATE OF CORRECTION

PATENT NO. : 4,500,089

DATED : February 19, 1985

INVENTOR(S) : Arthur A. Jones

It is certified that error appears in the above-identified patent and that said Letters Patent are hereby corrected as shown below:

Col. 2, line 8, "level" should be --lever--.

Col. 7, line 19, after "rollers" insert --being supported--.

Signed and Sealed this

*Eighteenth* Day of *June 1985*

[SEAL]

*Attest:*

DONALD J. QUIGG

*Attesting Officer*

*Acting Commissioner of Patents and Trademarks*